US007073207B2

(12) United States Patent
Kim

(10) Patent No.: US 7,073,207 B2
(45) Date of Patent: Jul. 11, 2006

(54) CAP LINKED BY STRINGS

(75) Inventor: Seong Jin Kim, Seoul (KR)

(73) Assignee: DADA Corp., Seoul (KR)

( * ) Notice: Subject to any disclaimer, the term of this patent is extended or adjusted under 35 U.S.C. 154(b) by 0 days.

(21) Appl. No.: 10/959,064

(22) Filed: Oct. 7, 2004

(65) Prior Publication Data

US 2006/0048276 A1 Mar. 9, 2006

(30) Foreign Application Priority Data

Aug. 21, 2004 (KR) ..... 10-2004-0066134

(51) Int. Cl.
*A42B 1/00* (2006.01)

(52) U.S. Cl. ..... 2/195.1; 2/209.3

(58) Field of Classification Search ..... 2/195.1, 2/195.4, 195.5, 195.6, 175.4, 175.5, 195.3, 2/200.1, 200.3, 195.2
See application file for complete search history.

(56) References Cited

U.S. PATENT DOCUMENTS

| | | | | | |
|---|---|---|---|---|---|
| 742,731 | A | * | 10/1903 | Plato | 2/175.5 |
| 919,984 | A | * | 4/1909 | Powell et al. | 2/209.11 |
| 4,106,119 | A | | 8/1978 | Taupin | |
| 4,214,318 | A | | 7/1980 | Gomez | |
| 4,682,373 | A | | 7/1987 | Baran | |
| 4,839,924 | A | | 6/1989 | Laurence | |
| 5,450,629 | A | | 9/1995 | Gilstrap | |
| 5,515,546 | A | * | 5/1996 | Shifrin | 2/209.11 |

* cited by examiner

*Primary Examiner*—John J. Calvert
*Assistant Examiner*—Richale Haney

(57) ABSTRACT

A cap or visor consisting a crown portion or rim portion and a visor protion is secured to the front bottom of the crown portion. The crown portion, rim portion, or the visor portion, or any combination thereof is separated with at least one gap, both sides of the separated portion are punched with proper size, which are linked each other by the strings passing through the punched holes, and the string length controller is located in the rear of crown portion, which can be tightened or loosened.

6 Claims, 5 Drawing Sheets

CAP LINKED BY STRINGS

BACKGROUND OF THE INVENTION

1. Field of the Invention

The present invention relates generally to a cap linked by strings, and more particularly, to a cap designed for a visual aesthetic sense effect and convenient keeping and carrying.

2. Description of the Prior Art

Headwears have been used for a variety of purpose and are in many shapes and sizes. One of the most popular headwears is a baseball-style cap. A typical baseball-style cap generally includes a crown which is the main portion having a plurality of panels a visor, which is attached to the front bottom of said crown portion, and a size controller which is attached to the rear side of said crown.

And, this kind of caps had originally been used by sportsmen with a view to block the sunlight through the visor portion of caps.

But, people currently use headwear as a kind of fashion to express their style beyond the purpose to protect their faces from sunlight and, on this trend, without distinction of age or sex, it is widely used in our daily lives.

And, in order to satisfy the needs of the users who consider their headwear as a part of their fashion, the number of headwear to which various changes are applied have been developed. Among them, in U.S. Pat. No. 5,477,629 applied by Richard F. Gleason, Jr., it is introduced that the various presentations in front of crown portion or visor portion is applied by attaching or detaching many kinds of ornament made with Velcro fastener.

Another method is described in U.S. Pat. No. 4,873,726 applied by Ray Tapia. this patent introduces that the visor of cap, various shapes of emblems and insignias, etc, can be attached or detached from a cap making them exchangeable in just one cap.

However, users were not satisfactory only with the simple changes above, and furthermore the changes have showed the limitation that they use only Velcro fastener causing just decreasing the visual artistic effect.

SUMMARY OF THE INVENTION

In view of the foregoing, a primary object of the present invention provides the design which can cause users' interest by separating the visor or crown portion and linking the separated portion with strings, so, allowing the portion to have more improved visual artistic effect.

Another object of the present invention provides the cap having a size controlling function as the string is smoothly stretched within the range of user's head size because of the elasticity of string.

The other object of the present invention is to provide the cap designed with the function of convenient keeping and carrying as both separated portion is foldable, yet folding of the cap does not damage the shape of the visor and crown.

In order to achieve the foregoing objects, the present invention provides a cap linked by strings, which includes a crown portion which is formed of a plurality of panels and a visor portion which is attached to the bottom of front portion of the crown, and a string length controller in the rear portion of the crown. Said each crown and visor portion is separated at least one section, both sides of the separated portion are punched with proper size, which are linked each other by the string passing through the punched holes.

And the material with or without elasticity may be used for said string, which has different color with the panels of said crown and visor portion so that the contrast effect is achieved.

DESCRIPTION OF THE PREFERRED EMBODIMENT

Figure 1:
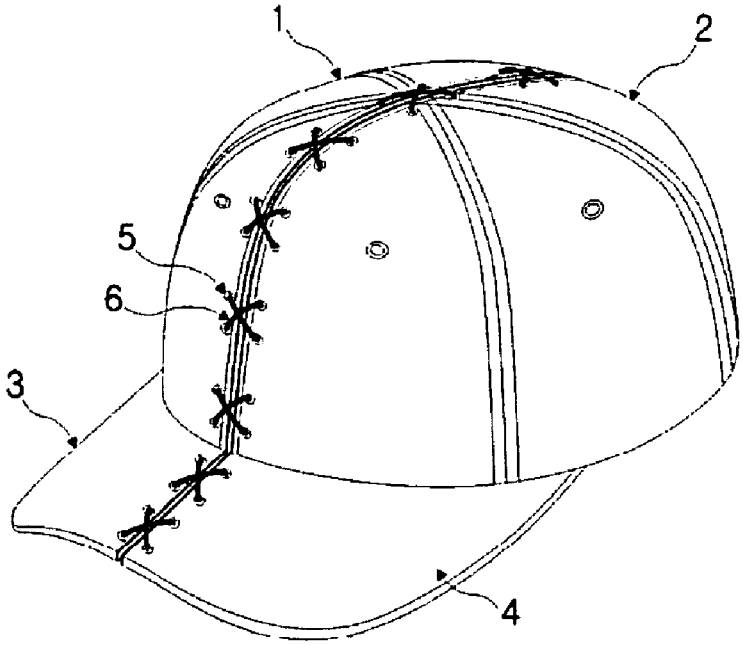
FIG. 1 is a perspective view of the cap according to the first preferred embodiment of the present invention.
Figure 2:
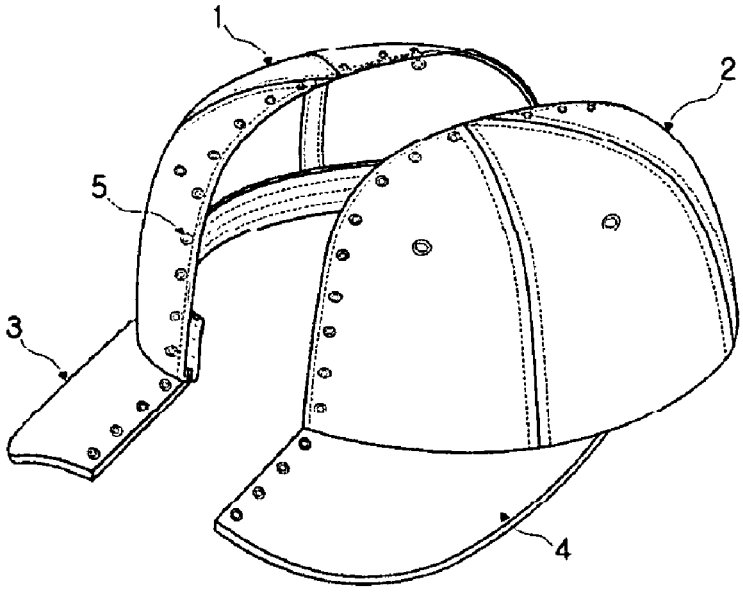
FIG. 2 is a separated structure view of the cap according to the first preferred embodiment of the present invention.
Figure 5:
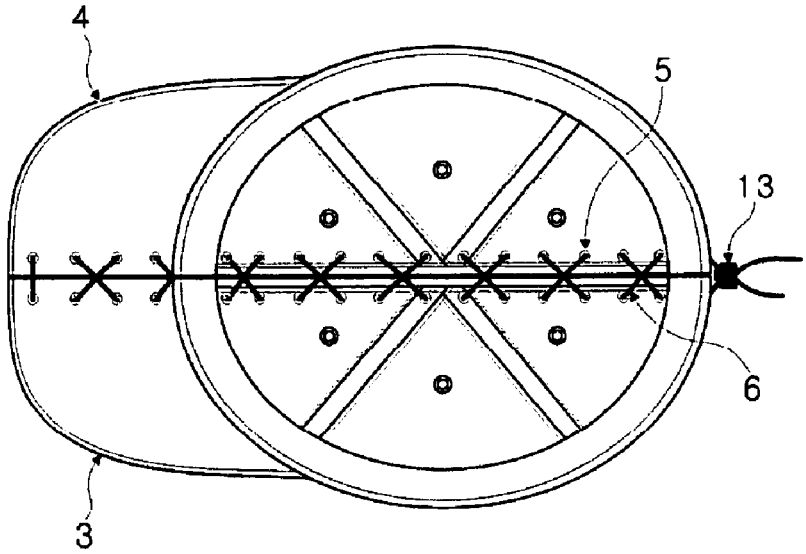
FIG. 5 is a bottom view of the cap according to the first preferred embodiment of the present invention.

In accordance with the first preferred embodiment of the present invention, and with reference to FIG. 1, 2 and 5, a cap is consisted of a crown portion (1,2) which is main portion and is formed of a plurality of fabric panels, a visor portion (3,4) which is secured to the bottom of front portion of the crown (1,2), and a string length controller (13) in the rear portion of the crown. Said each crown (1,2) and visor portion (3,4) is separated with at least one gap, and both sides of the separated section are punched with proper size and interval. And each separated crown and visor portion is linked by StringS (6) passing through the punched holes (5). The eyelets are inserted into the punched holes. And The visor portions and/or crown portions can have one gap (i.e., dividing two sections) or more than one gap (i.e., dividing more than two sections).

In addition, the cap, of which said each crown and visor portion is separated and the separated sections are linked with strings (6), provides users with the visual aesthetic sense effect. In the shape of the string link also, it is possible to link the strings in various shapes except for the intersection type, and by using different color on the strings (6) from the ones of the separated panels so that the contrast effect is achieved, increasing the visual aesthetic sense effect more.

And materials with or without elasticity may be used for the strings liking said separated sections. As there is a string length controller (13) designed to the rear side of said crown it is possible to tighten or loosen the length of the string, and because size control could be done not only in the circumference of crown portion but also in the central portion of crown portion linked with strings, very precise control is available.

Figure 3:
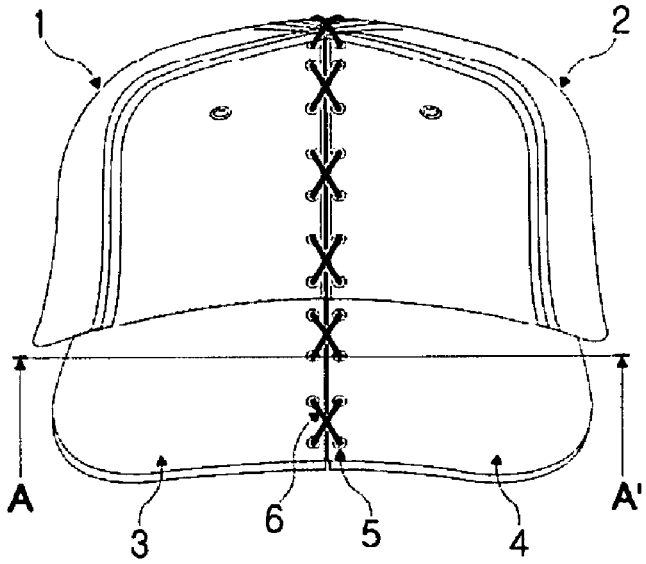
FIG. 3 is a front view of the cap according to the first preferred embodiment of the present invention.
Figure 4:
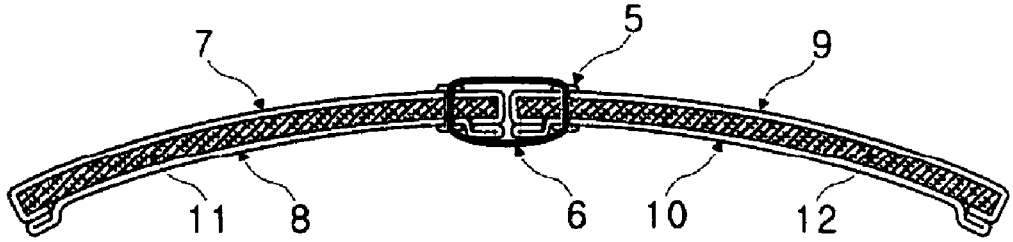
FIG. 4 is a partially sectioned view of magnifying A–A' section on FIG. 3.

FIG. 3 is a front view of the cap according to the first preferred embodiment of the present invention, and FIG. 4 is a partially sectioned view of magnifying A–A' section on FIG. 3. As shown in FIG. 3 and 4, each crown (1,2) and visor portion (3,4) is separated with at least one gap, and both sides of the separated section are punched with proper size and interval, and strings (6) passing through the punched holes (5) links each separated section of the crown (1,2) and visor (3,4) each other. To see the formation of said linked section of crown portion (1,2), the separated visor portion consists of the hard or soft visor cores (11,12) having each certain thickness, upper fabrics (7,9) and under fabrics (8,10) wrapping the visor cores (11,12), the punched sections (5) with a proper size on both sides of the separated sections of visor portion, and the string (6), which passes through the punched holes (5), linking each separated section.

Figure 6:
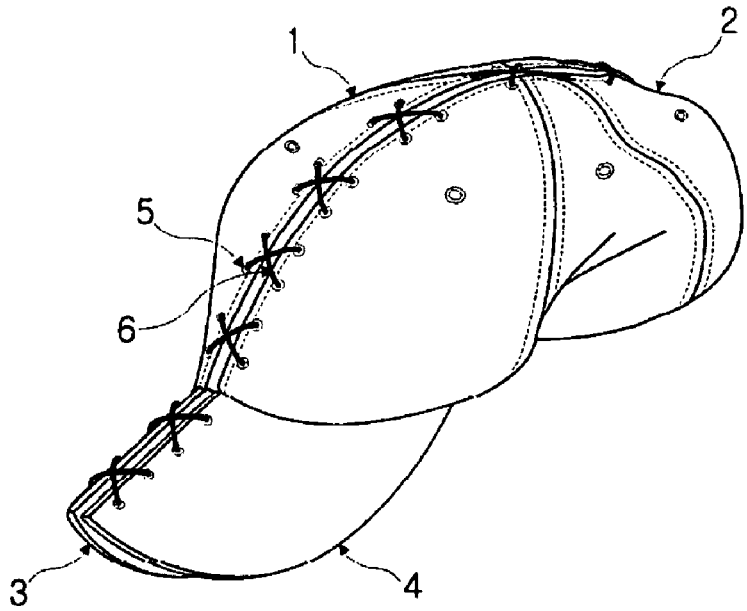
FIG. 6 is a perspective view of the folded cap according to the first preferred embodiment of the present invention.

FIG. 6 is a perspective view of the folded cap according to the first preferred embodiment of the present invention. As shown in FIG. 6, the cap of the embodiment of the present invention has the separated sections of crown portion (1,2) and visor portion (3,4), which are folded or unfolded along the separated sections linked with strings (6). And the strings (6) are made of elastic material so that folding or unfolding is easy. As the cap, above all, can be folded or unfolded along the linked section, users can easily keep and carry it.

Figure 7:
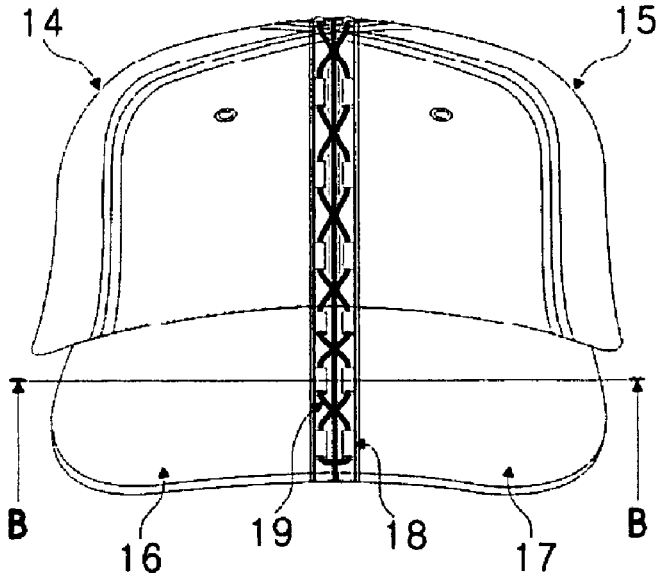
FIG. 7 is a front view of the cap according to the second preferred embodiment of the present invention.
Figure 8:
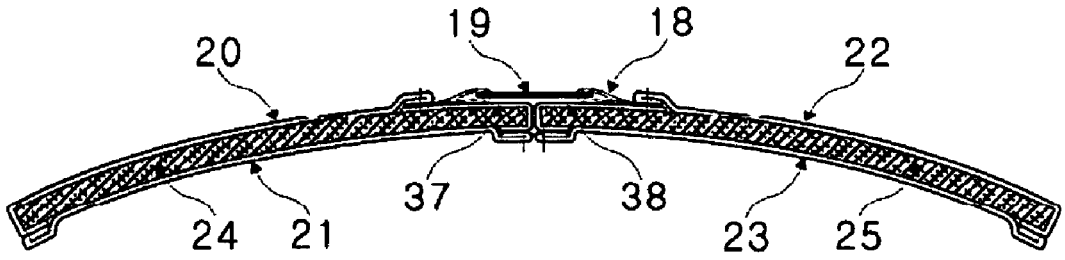
FIG. 8 is a partially sectioned view of magnifying B–B' section on FIG. 7.

FIG. 7 is a front view of the cap according to the second preferred embodiment of the present invention, and FIG. 8 is a partially sectioned view of magnifying B–B' section on FIG. 7. As shown in FIG. 7 and 8, likewise the the first preferred embodiment, the cap of the embodiment of the present invention basically consists of crown portion (14,15) which is made of more than one panel, and visor portion (16,17) which is secured to the bottom of front portion of said crown (14,15). And the crown portion and visor portion are separated along with at least one gap, and the separated section are linked with strings (19). And the separated section linked by a string consists of linking hook section (18), which is linked between the additional panels (37,38), which is different from the panels of the crown portion and visor portion adjacent to the linked section, and the panels adjacent to the additional panels so that the strings (19) can be passed through. To see the formation of visor portion linked by the string, the visor portion (16,17) consists of the hard or soft visor cores (24,25) having each certain thickness, upper fabrics (20,22) and under fabrics (21,23) wrapping the visor cores (24,25), the additional fabrics (37,38), which is located in the separated section of visor portion, connecting upper fabrics (20,22) and under fabrics (21,23), and linking hook section (18), which is linked between the additional fabrics (37,38) and upper fabrics (20,22) of visor portion.

Figure 9:
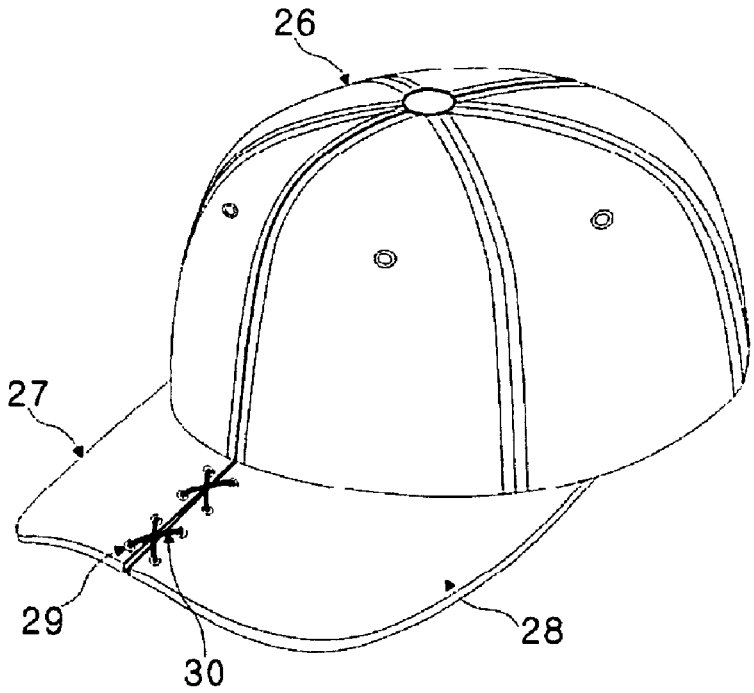
FIG. 9 is a perspective view of the cap according to the third preferred embodiment of the present invention.

FIG. 9 is a perspective view of the cap according to the third preferred embodiment of the present invention. As shown in FIG. 9, likewise other embodiments, the cap of the embodiment of the present invention basically consists of crown portion (26) which is made of more than one panel, and visor portion (27,28) which is secured to the bottom of front portion of the crown (26). The crown portion (26) is not separated, and only visor portion (27,28) is separated and linked again. Said visor portion is separated along with at least one gap, and both sides of the separated section are punched with proper size and interval. And strings (30) passing through the punched holes (29) links separated visor section.

Figure 10:
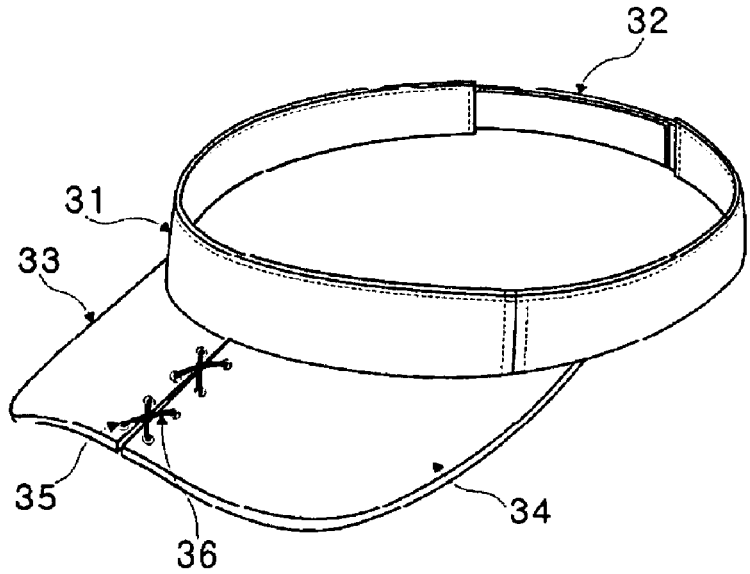
FIG. 10 is a perspective view of a visor according to the fourth preferred embodiment of the present invention.

FIG. 10 is a perspective view of a visor according to the fourth preferred embodiment of the present invention. As shown In FIG. 10, The art of the present invention can be applied to the visor. The visor of the embodiment of the present invention consists of the rim portion (31), which is made of more than one panel, a size controlling portion (32) which is secured to the rear portion of said rim portion, and the visor portion (33,34) which is secured to the bottom of front portion of the rim portion (31). The center portion of said visor portion is separated with at least one gap, and both sides of the separated section are punched with proper size. And strings (36) passing through the punched holes (35) links separated sections of the visor. Likewise other embodiments, the contrast effect can be achieved by configuring different color on the strings from the ones of other adjacent panels, and, as the cap can be folded or unfolded along the section linked by strings, users can easily keep and carry it.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A baseballstyled cap linked by string comprising:

a crown portion having at least one panel; and a visor portion secured to a forward portion of said peripheral edge of the crown portion;

and the visor portion is separated with at least one gap, each separated visor portion consists of a visor core having certain thickness, upper fabric and under fabric wrapping a visor core, additional fabrics, which are located in the separated section, connecting upper fabrics and under fabrics, and a linking hook section, which is linked between the additional fabrics and upper fabrics, and strings passing through the linking hook section link each separated section of the visor to each other.

2. The cap as set forth in claim 1, wherein the crown portion is separated with at least one gap, the crown portion consists of additional fabrics, which are located at each separated section and linked to the adjacent crown panel, and strings passing through the linking hook section link each separated section of the crown portion to each other.

3. The cap as set forth in claim 1 or 2, wherein the eyelets are inserted into the punched holes.

4. The cap as set forth in claim 2, wherein the string length controller is located in the rear portion of crown portion, which can be tightened or loosened.

5. The cap as set forth in claim 1 or 2, wherein the strings, linking said separated sections, is made of elastic material.

6. The cap as set forth in claim 1 or 2, wherein the strings, linking said separated sections, is made of nonelastic material.

* * * * *